US012421567B2

(12) United States Patent
Kobayashi et al.

(10) Patent No.: US 12,421,567 B2
(45) Date of Patent: Sep. 23, 2025

(54) HIGH-STRENGTH HOT-ROLLED STEEL SHEET

(71) Applicant: NIPPON STEEL CORPORATION, Tokyo (JP)

(72) Inventors: Yukiko Kobayashi, Tokyo (JP); Jun Takahashi, Tokyo (JP); Tatsuo Yokoi, Tokyo (JP); Riki Okamoto, Tokyo (JP); Takeshi Toyoda, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 494 days.

(21) Appl. No.: 17/918,903

(22) PCT Filed: Apr. 15, 2021

(86) PCT No.: PCT/JP2021/015587
§ 371 (c)(1),
(2) Date: Oct. 14, 2022

(87) PCT Pub. No.: WO2021/210644
PCT Pub. Date: Oct. 21, 2021

(65) Prior Publication Data

US 2023/0287530 A1 Sep. 14, 2023

(30) Foreign Application Priority Data

Apr. 17, 2020 (JP) ..... 2020-074180

(51) Int. Cl.
*C21D 8/02* (2006.01)
*C21D 9/46* (2006.01)
(Continued)

(52) U.S. Cl.
CPC ..... *C21D 8/0226* (2013.01); *C21D 9/46* (2013.01); *C22C 38/001* (2013.01);
(Continued)

(58) Field of Classification Search
None
See application file for complete search history.

(56) References Cited

U.S. PATENT DOCUMENTS

2003/0063996 A1 4/2003 Funakawa et al.
2004/0074573 A1 4/2004 Funakawa et al.
(Continued)

FOREIGN PATENT DOCUMENTS

CN 107849651 A 3/2018
EP 2952600 B1 6/2018
(Continued)

OTHER PUBLICATIONS

G. K. Williamson and R. E. Smallman, "Dislocation densities in some annealed and cold-worked metals from measurements on X-ray Debye-Scherrer spectrum", Philosophical Magazine, vol. 1, 1956, p. 34-46.

*Primary Examiner* — Anthony M Liang
(74) *Attorney, Agent, or Firm* — SOLARIS Intellectual Property Group, PLLC

(57) ABSTRACT

A high-strength hot-rolled steel sheet: having a predetermined chemical composition; having a mean dislocation density of from $1\times10^{14}$ to $1\times10^{16}$ $m^{-2}$, and containing at least bainitic ferrite, in which a total area ratio of the bainitic ferrite and ferrite is 70% or more and less than 90%, and in which a total area ratio of martensite and retained austenite is 5% or more and 30% or less, in which, in ferrite crystal grains and in bainitic ferrite crystal grains, a mean number density of TiC precipitates is from $1\times10^{17}$ to $5\times10^{18}$ [precipitates/$cm^3$], in which an amount of Ti present as a TiC precipitate precipitated in a matrix not on dislocations is 30 mass % or more of a total amount of Ti in the steel sheet, and in which a tensile strength is 850 MPa or more.

6 Claims, 2 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |

(52) U.S. Cl.

CPC ..... *C22C 38/002* (2013.01); *C22C 38/02* (2013.01); *C22C 38/04* (2013.01); *C22C 38/06* (2013.01); *C22C 38/14* (2013.01); *C21D 2211/001* (2013.01); *C21D 2211/002* (2013.01); *C21D 2211/005* (2013.01); *C21D 2211/008* (2013.01)

(56) References Cited

U.S. PATENT DOCUMENTS

| | | | |
|---|---|---|---|
| 2006/0096678 | A1 | 5/2006 | Kariya |
| 2018/0209007 | A1 | 7/2018 | Sugiura et al. |

FOREIGN PATENT DOCUMENTS

| | | | |
|---|---|---|---|
| EP | 3330394 | A1 | 6/2018 |
| JP | H07-011382 | A | 1/1995 |
| JP | 2003-089848 | A | 3/2003 |
| JP | 2007-247046 | A | 9/2007 |
| JP | 2007-262487 | A | 10/2007 |
| JP | 2013-133534 | A | 7/2013 |
| JP | 2017-179539 | A | 10/2017 |

HIGH-STRENGTH HOT-ROLLED STEEL SHEET

TECHNICAL FIELD

The present disclosure relates to a high-strength hot-rolled steel sheet.

BACKGROUND ART

As a strengthening method of increasing the strength of steel, (1) solid solution strengthening by addition of elements such as C, Si, and Mn, (2) precipitation strengthening using precipitates such as Ti and Nb, and (3) transformation hardening using a microstructure as a continuous cooling transformation microstructure in which dislocation strengthening or crystal fine grain strengthening is expressed are effective. In particular, members for automobiles are being reduced in weight and improved in safety and durability, and there is a demand for an increase in strength of a steel material as a material.

Solid solution strengthening has a smaller strength increasing effect than precipitation strengthening and transformation hardening, and thus it is difficult to increase the strength required of a material for an automobile member only by solid solution strengthening.

On the other hand, with regard to precipitation strengthening, technological development for achieving high strength while maintaining excellent deformability of the original uniform structure of a ferrite phase has started to be studied again in recent years. For example, a method has been proposed in which carbide forming elements such as Ti, Nb, and Mo are utilized to precipitate fine carbides to strengthen the ferrite structure (for example, Patent Documents 1 to 3). In a structure having a relatively low dislocation density, which is mainly composed of ferrite, fine carbides for improving strength are precipitated to increase strength by precipitation strengthening.

According to these methods, it is necessary to form a ferrite structure transformed at a relatively high temperature in order to develop precipitation strengthening. In order to develop dislocation strengthening, it is necessary to perform phase transformation at a low temperature, and thus it is difficult to develop both precipitation strengthening and dislocation strengthening.

On the other hand, there has been proposed a high-strength steel sheet having excellent stretch flangeability, which includes an acicular ferrite structure transformed at a relatively low temperature and has a structure in which fine carbides TiC and NbC are precipitated (for example, Patent Document 4).

In general, it is known that precipitates are more likely to be nucleated in defects such as dislocations and crystal grain boundaries than in portions without defects. Therefore, conventionally, when the dislocation density is increased, it has been used for the purpose of promoting precipitation on dislocations (for example, Patent Document 5).

Note that Non-Patent Document 1 proposes calculating the dislocation density using strain of a crystal lattice obtained by measuring X-ray diffraction.

Patent Document 1: Japanese Patent Application Laid-Open (JP-A) No. 2003-89848

Patent Document 2: Japanese Patent Application Laid-Open (JP-A) No. 2007-262487

Patent Document 3: Japanese Patent Application Laid-Open (JP-A) No. 2007-247046

Patent Document 4: Japanese Patent Application Laid-Open (JP-A) No. H7-11382

Patent Document 5: Japanese Patent Application Laid-Open (JP-A) No. 2013-133534

Non-Patent Document 1: G. K. Williamson and R. E. Smallman, "Dislocation densities in some annealed and cold-worked metals from measurements on X-ray Debye-Scherrer spectrum", Philosophical Magazine, Vol. 1, 1956, p. 34-46.

SUMMARY OF INVENTION

Technical Problem

However, in Patent Documents 4 and 5, studies on utilization of both precipitation strengthening and dislocation strengthening have not been sufficient. In order to increase the strength of the precipitation-strengthened steel, generally, a method of increasing a precipitation strengthening amount by increasing a content of an alloy element is considered. However, not only the cost may increase, but also workability and the like may deteriorate, and an end face of a hole formed by punching a steel sheet may be damaged, for example, peeled or turned up. There has been room for examination for further increasing the strength while suppressing the content of the alloy element.

Therefore, an object of the present disclosure is to provide a high-strength hot-rolled steel sheet which suppresses damage to a punched edge of the steel sheet while suppressing a content of an alloy element, and has a tensile strength of 850 MPa or more.

Solution to Problem

The present inventors aimed to obtain a large precipitation strengthening by precipitating fine TiC precipitates after phase transformation while increasing the dislocation density of a steel sheet by phase transformation to increase dislocation strengthening. Therefore, the present inventors actively utilized bainitic ferrite having a high dislocation density for the purpose of finely precipitating TiC precipitates after the bainitic ferrite is formed. However, precipitation strengthening is not effectively exhibited when TiC precipitates are precipitated on dislocations. Therefore, the present inventors aimed to efficiently exhibit dislocation strengthening and precipitation strengthening by precipitating TiC precipitates on a matrix that is not on the dislocations.

Then, the present inventors have found that it is possible to suppress a content of an alloy element and to obtain high tensile strength while suppressing cost by efficiently developing both dislocation strengthening due to a high dislocation density and precipitation strengthening due to formation of a TiC precipitate in a matrix not on dislocations and effectively utilizing the alloy element. Furthermore, the present inventors have found that a decrease in workability due to the content of the alloy element is also suppressed, and that the occurrence of damage on a punched edge of the steel sheet is suppressed.

The present disclosure has been made based on such findings, and the gist thereof is as follows.

(1) A high-strength hot-rolled steel sheet having a chemical composition containing, by mass:

C: from 0.030 to 0.250%;

Si: from 0.01 to 1.50%;

Mn: from 0.1 to 3.0%;

Ti: from 0.040 to 0.200%;

P: 0.100% or less;
S: 0.005% or less;
Al: 0.500% or less;
N: 0.0090% or less;
B: from 0 to 0.0030%;
a total of one or more of Nb, Mo and V: from 0 to 0.040%;
a total of one or more of Ca and REM: from 0 to 0.010%; and
a balance consisting of Fe and impurities, a mass ratio [Ti]/[C] of a Ti amount to a C amount being from 0.16 to 3.00, and a product [Ti]×[C] of the Ti amount and the C amount being from 0.0015 to 0.0160,
the high-strength hot-rolled steel sheet:
having a mean dislocation density of from $1\times10^{14}$ to $1\times10^{16}$ $m^{-2}$; and
containing at least bainitic ferrite,
wherein a total area ratio of the bainitic ferrite and ferrite is 70% or more and less than 90%,
wherein a total area ratio of martensite and retained austenite is 5% or more and 30% or less,
wherein, in ferrite crystal grains and in bainitic ferrite crystal grains, a mean number density of TiC precipitates is from $1\times10^{17}$ to $5\times10^{18}$ [precipitates/$cm^3$],
wherein an amount of Ti present as a TiC precipitate precipitated in a matrix not on dislocations is 30 mass % or more of a total amount of Ti in the steel sheet,
wherein a tensile strength is 850 MPa or more, and
wherein [Ti] and [C] represent the Ti amount and the C amount (mass %), respectively.

(2) The high-strength hot-rolled steel sheet according to (1), containing, by mass:
B: 0.0001% or more and less than 0.0005%.

(3) The high-strength hot-rolled steel sheet according to (1) or (2), containing, by mass:
the total of one or more of Nb, Mo, and V: from 0.01 to 0.040%.

(4) The high-strength hot-rolled steel sheet according to any one of (1) to (3), containing, by mass:
the total of one or more of Ca and REM: from 0.0005 to 0.01%.

(5) The high-strength hot-rolled steel sheet according to any one of (1) to (4), wherein the total area ratio of the bainitic ferrite and the ferrite is 80% or more and less than 90%.

(6) The high-strength hot-rolled steel sheet according to any one of (1) to (5), wherein an area ratio of the bainitic ferrite is 50% or more and less than 90%.

Advantageous Effects of Invention

According to the present disclosure, it is possible to provide a high-strength hot-rolled steel sheet which has high tensile strength while suppressing a content of an alloy element, and in which damage to a punched edge of the steel sheet is less likely to occur during punching.

DESCRIPTION OF EMBODIMENTS

Figure 1A:
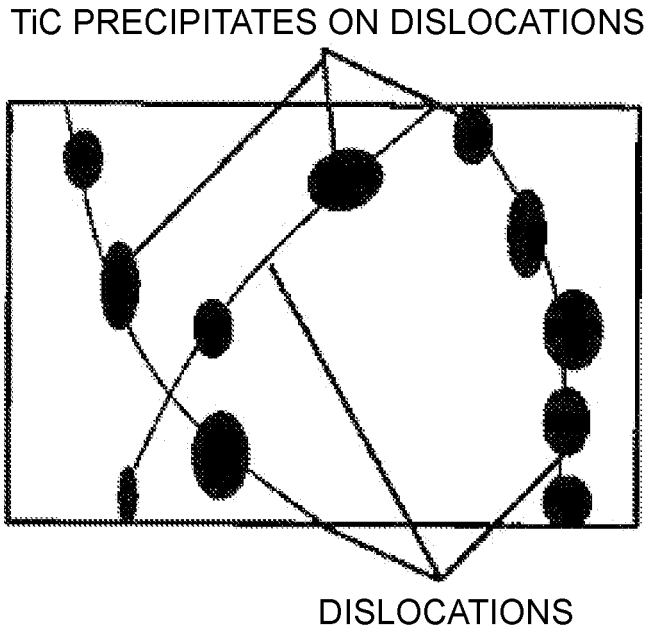
FIG. 1A shows a schematic diagram of an arrangement of TiC precipitates on dislocations.

Hereinafter, an exemplary embodiment of the present disclosure will be described in detail.

In the present specification, the "%" indication of a content of each element of a chemical composition means "mass %".

The content of each element of the chemical composition is sometimes referred to as "element amount". For example, the content of C is sometimes expressed as C amount.

A numerical range indicated using "to" means a range including numerical values described before and after "to" as a lower limit value and an upper limit value.

A numerical range when "greater than" or "less than" is attached to numerical values described before and after "to" means a range not including these numerical values as a lower limit value or an upper limit value.

In the numerical ranges according to stages herein, the upper limit value according to one numerical range may be replaced with the upper limit value of any other numerical range according to stages, and may be replaced with a value described in an Example. The lower limit value according to one numerical range may be replaced with the lower limit value of any other numerical range according to stages, and may be replaced with a value described in an Example.

"0 to" as the content (%) means that the component is an optional component and need not be contained.

The term "step" includes not only an independent step but also a step that cannot be clearly distinguished from other steps as long as the intended purpose of step is achieved.

<High-Strength Hot-Rolled Steel Sheet>

A high-strength hot-rolled steel sheet according to the present embodiment (hereinafter sometimes simply referred to as "steel sheet"):
has a predetermined chemical components, in which a mass ratio [Ti]/[C] of a Ti content to a C content is from 0.16 to 3.00, and a product [Ti]×[C] of the Ti content and the C content is from 0.0015 to 0.0160,
has a mean dislocation density of from $1\times10^{14}$ to $1\times10^{16}$ $m^{-2}$; and
contains at least bainitic ferrite.

A total area ratio of the bainitic ferrite and ferrite is 70% or more and less than 90%.

A total area ratio of martensite and retained austenite is 5% or more and 30% or less.

In ferrite crystal grains and in bainitic ferrite crystal grains, a mean number density of TiC precipitates is from $1\times10^{17}$ to $5\times10^{18}$ [precipitates/$cm^3$].

A content of Ti present as a TiC precipitate precipitated in a matrix not on dislocations is 30 mass % or more of a total Ti content of the steel sheet.

A tensile strength is 850 MPa or more.

[Ti] and [C] represent the Ti amount and the C amount (mass %), respectively.

By virtue of the above configuration, the high-strength hot-rolled steel sheet according to the present embodiment is a high-strength hot-rolled steel sheet having high tensile strength and in which damage to a punched edge of the steel sheet is less likely to occur during punching. The high-strength hot-rolled steel sheet according to the present embodiment has been found by the following findings.

In order to improve the strength of the steel sheet, it is important to control an existence state of Ti in the steel sheet. First, there are mainly three possible existence states in which Ti exists as a solid solution, as a coarse TiN precipitate or a TiS precipitate, and as a TiC precipitate. First, TiN precipitates or TiS precipitates have a very small solubility product in iron, are precipitated even in a relatively high temperature austenite region, and become coarse, and thus do not contribute to the strength of the steel sheet. An amount of TiN precipitates or TiS precipitates precipitated is almost determined by contents of N and S in the steel sheet. Whether residual Ti is precipitated as a TiC precipitate or remains as a solid solution atom greatly changes due to the influence of thermomechanical treatment of the steel sheet. In the case of Ti as a solid solution, Ti is uniformly present as a single atom in crystal grains, and the strengthening mechanism of the steel sheet is a solid solution strengthening, but an amount of increase in strength is small. On the other hand, when Ti is precipitated as a TiC precipitate, the precipitation strengthening amount greatly changes depending on the number density and size of the precipitate, and thus greatly affects the strength of the steel sheet. Furthermore, it has been found that the position where the TiC precipitate precipitates affects the strength of the steel material.

The present inventors paid attention to a position where a TiC precipitate (hereinafter, also simply referred to as "precipitate") is formed.

As the position where the precipitates are formed, a case where the precipitates are precipitated and formed at crystal grain boundaries, a case where the precipitates are precipitated and formed on dislocations in crystal grains, and a case where the precipitates are uniformly precipitated and formed in a matrix (hereinafter, also simply referred to as "matrix") that is not on the dislocations in the crystal grains were considered. It is considered that normal steel having a crystal grain size of several micrometers or more has a low density of crystal grain boundaries, and precipitates at the crystal grain boundaries do not contribute to strengthening. The precipitates have a property of being preferentially nucleated on dislocations as compared with the matrix, but it is considered that whether the precipitates are precipitated on dislocations or are uniformly precipitated in the matrix depends on the hot rolling temperature and chemical composition, the degree of supercooling and the diffusion length of precipitate-forming elements, the dislocation density, and the like.

Therefore, the present inventors considered that the position where TiC precipitates are precipitated, the number density, the relationship between the contents of Ti and C in the steel sheet, and the microstructure affect the strength of the steel sheet, and conducted studies.

The present inventors melted and hot-rolled a steel piece containing, in mass %, C: from 0.030 to 0.250%, Si: from 0.01 to 1.50%, Mn: from 0.1 to 3.0%, Ti: from 0.040 to 0.200%, P: from 0.100% or less, S: 0.005% or less, Al: 0.500% or less, N: 0.0090% or less, B: from 0 to 0.0030%, a total of one or two or more of Nb, Mo and V: from 0 to 0.040%, and a total of one or two or more of Ca and REM: from 0 to 0.010%, the balance consisting of Fe and impurities, to manufacture a steel sheet under various heat treatment conditions, and conducted the following tests and studies.

The mean dislocation density of the obtained steel sheet was measured.

The present inventors determined that a large dislocation strengthening was obtained when the mean dislocation density was in a range of from $1\times10^{14}$ to $1\times10^{16}$ $m^{-2}$, and the subsequent tests were performed on steel sheets having a mean dislocation density in the range of from $1\times10^{14}$ to $1\times10^{16}$ $m^{-2}$.

First, a test piece was taken from the steel sheet, and the tensile strength was measured.

Next, the microstructure was observed, the mean number density of the TiC precipitates precipitated in the crystal grains was measured, and the formation position of the TiC precipitates was observed.

Figure 2:
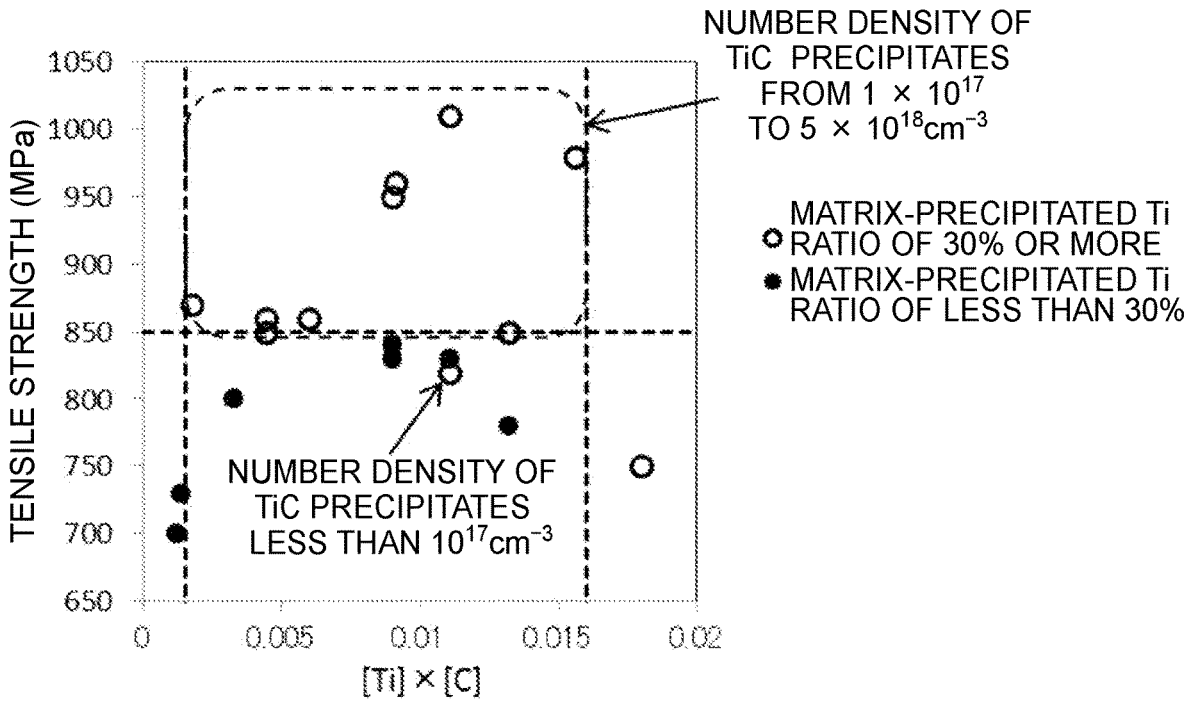
FIG. 2 is a diagram showing relationship between [Ti]×[C] and tensile strength, between the case where a content of Ti present as a TiC precipitate precipitated in the matrix that is not on the dislocations is 30 mass % or more and the case where the content of Ti is less than 30% of a total Ti content of a steel sheet having a mean dislocation density in a range of from $1\times10^{14}$ to $1\times10^{16}$ $m^{-2}$.

For a steel sheet having a mean dislocation density in the range of from $1\times10^{14}$ to $1\times10^{16}$ $m^{-2}$, relationship between [Ti]×[C] and the tensile strength when the Ti content is denoted by [Ti] and the C content is denoted by [C] is shown in FIG. 2. FIG. 2 also shows relationship of the number density of TiC precipitates and relationship between the case where the content of Ti present as TiC precipitates precipitated in the matrix not on dislocations is 30 mass % or more and the case where the content of Ti is less than 30% of a total Ti content of the steel sheet.

It is found that, in ferrite crystal grains and bainitic ferrite crystal grains, high strength of 850 MPa or more as a target is obtained when the mean number density of TiC precipitates is from $1\times10^{17}$ to $5\times10^{18}$ [precipitates/$cm^3$], and the content of Ti present as TiC precipitates precipitated in the matrix not on dislocations is 30 mass % or more of the total Ti content of the steel sheet. In addition, it was found that the value of [Ti]×[C] needs to be in the range of from 0.0015 to 0.0160 in order to obtain the above structure.

The reason why the strength of the steel sheet becomes higher when the content of Ti present as TiC precipitates precipitated in the matrix not on dislocations is high is considered as follows. First, as the existence state of Ti other than the TiC precipitates precipitated in the matrix, there are coarse TiN precipitates or coarse TiS precipitates described above, solid solution Ti atoms, and TiC precipitates on dislocations. The coarse TiN precipitates or coarse TiS precipitates and the solid solution Ti atoms provide a small strengthening amount for the reasons described above. Next, when the TiC precipitates exist on dislocations, the dislocations as obstacles and the TiC precipitates overlap with each other in position, so that the precipitates are less likely to contribute as new obstacles to suppress an increase in the strengthening amount. On the other hand, when the TiC precipitates are precipitated in the matrix, both dislocations and the TiC precipitates effectively act as obstacles at the time of deformation, so that precipitation strengthening can be more effectively utilized.

[Ti]×[C] is related to a temperature at which the TiC precipitates are completely dissolved, that is, a lower limit temperature at which the TiC precipitates are not generated. When the value of [Ti]×[C] is small, the lower limit temperature at which Ti and C are not precipitated is low, and, when the value of [Ti]×[C] is large, the lower limit temperature at which Ti and C are not precipitated is high.

As shown in FIG. 2, when the value of [Ti]×[C] was less than 0.0015, the content of Ti present as TiC precipitates precipitated in the matrix could not be increased. The reason for this is considered to be due to insufficient degree of supercooling in a cooling step. When the value of [Ti]×[C] is small, the temperature at which TiC precipitates are precipitated is low, and thus the degree of supercooling is lowered. It is considered that, when the degree of supercooling is small, a driving force for precipitation is small, and a frequency of precipitation on dislocations where the precipitates are more easily nucleated is high, so that the frequency of precipitation of TiC in the matrix cannot be increased. It is considered that, when the value of [Ti]×[C]

is 0.0015 or more, the degree of supercooling of TiC precipitation increases, the driving force for precipitation sufficiently increases, and precipitation occurs in the matrix in addition to precipitation on dislocations.

On the other hand, even when the value of [Ti]×[C] exceeded 0.0160, and the ratio of Ti present as a TiC precipitate precipitated in the matrix was increased, the strength decreased. This is considered to be because the content concentrations of Ti and C are too high, so that the temperature at which the TiC precipitates are completely dissolved becomes higher than the temperature at which the TiC precipitates are solutionized in the austenite region, and a part of TiC is already precipitated. The TiC precipitates in the austenite region are coarse and have a low number density, and thus less contribute to precipitation strengthening. That is, it is considered that, when the value of [Ti]×[C] is more than 0.0160, the concentrations of Ti and C that generate fine precipitates contributing to precipitation strengthening cannot be increased, and therefore that large tensile strength cannot be obtained. Furthermore, it is considered that, as coarse TiC precipitates generated in the austenite region further grow during cooling, the concentrations of Ti and C contributing to the generation of fine precipitates after phase transformation may be lowered, or the number density may be lowered due to an increase in size of TiC precipitates, and that the effect of increasing the strength is small.

In addition, it is considered that the content of the alloy element can be reduced and the decrease in workability caused by the alloy element can be suppressed, by effectively utilizing the alloy element through efficient development of both precipitation strengthening and dislocation strengthening.

According to the above findings, the present inventors have found a high-strength hot-rolled steel sheet which has high tensile strength while suppressing a content of an alloy element, and in which damage to a punched edge of the steel sheet is less likely to occur during punching.

Hereinafter, details of the high-strength hot-rolled steel sheet according to the present embodiment will be described.

(Chemical Composition)

The chemical composition of the high-strength hot-rolled steel sheet according to the present embodiment contains the following elements.

—Essential Element—

C: from 0.030 to 0.250%

Carbon (C) is an important element that generates fine TiC precipitates and contributes to precipitation strengthening, and is also a necessary element that segregates at crystal grain boundaries to suppress the occurrence of damage to the punched edge of the steel sheet. An amount of C required for exhibiting the effect is 0.030% or more, but, when the amount of C is more than 0.250%, coarse cementite is generated, so that ductility, particularly, local ductility is reduced. Therefore, the amount of C is from 0.030 to 0.250%, preferably from 0.040 to 0.150%.

Si: from 0.01 to 1.50%

Silicon (Si) is a deoxidizing element, and an amount of Si is 0.01% or more. Si is an element that contributes to solid solution strengthening, but, when the amount of Si exceeds 1.50%, workability deteriorates. Therefore, an upper limit of the amount of Si is set to 1.50%. Therefore, the amount of Si is from 0.01 to 1.50%, preferably from 0.02 to 1.30%.

Mn: from 0.1 to 3.0%

Manganese (Mn) is an element effective for deoxidation and desulfurization and also contributes to solid solution strengthening, and therefore an amount of Mn is 0.1% or more. From the viewpoint of reducing an area ratio of polygonal ferrite, the amount of Mn is preferably 0.35% or more.

On the other hand, when the amount of Mn is more than 3.0%, segregation is likely to occur, so that the workability deteriorates, and the cost is increased, which is not preferable. Therefore, the amount of Mn is from 0.1 to 3.0%, preferably from 0.3 to 1.5%.

Ti: from 0.040 to 0.200%

Titanium (Ti) is an extremely important element that precipitates fine TiC precipitates in grains of ferrite and bainitic ferrite and contributes to precipitation strengthening. An amount of Ti is 0.040% or more because Ti precipitates in the matrix to increase the strength. On the other hand, when the amount of Ti exceeds 0.200%, not only the cost increases, but also the TiC precipitates tend to be coarsened, which makes manufacture difficult. In order to easily achieve a suitable number density of TiC precipitates, the amount of Ti is preferably 0.150% or less. Therefore, the amount of Ti is from 0.040 to 0.200%, preferably from 0.070 to 0.150%.

P: 0.100% or less

Phosphorus (P) is an impurity, and deteriorates workability and weldability. Therefore, an amount of P is preferably as low as possible, and is limited to 0.100% or less. The amount of P is preferably limited to 0.020% or less because P segregates at grain boundaries to decrease ductility. However, from the viewpoint of the cost for removal of P, the amount of P is preferably 0.005% or more.

S: 0.005% or less

Sulfur(S) is an impurity and particularly impairs hot workability. Therefore, an amount of S is preferably as low as possible, and is limited to 0.005% or less. In order to suppress a decrease in ductility due to an inclusion such as a sulfide, it is preferable to limit the amount of S to 0.002% or less. However, from the viewpoint of the cost for removal of S, the amount of S is preferably 0.0005% or more.

Al: 0.500% or less

Aluminum (Al) is a deoxidizing agent, and an amount of Al is 0.500% or less. When Al is excessively contained, a nitride is formed and ductility is lowered. Thus, the amount of Al is preferably limited to 0.150% or less. In order to sufficiently deoxidize molten steel, the amount of Al is preferably 0.002% or more.

N: 0.0090% or less

Nitrogen (N) forms TiN, reduces the workability of steel and also leads to a reduction in effective amount of Ti forming TiC precipitates. Therefore, an amount of N is preferably as low as possible, and is limited to 0.0090% or less. However, from the viewpoint of the cost for removal of N, the amount of N is preferably 0.0010% or more.

—Optional Element—

The chemical composition of the high-strength hot-rolled steel sheet according to the present embodiment may contain the following optional elements in addition to the essential elements.

B: from 0 to 0.0030%

Boron (B) is an optional element that can be optionally contained in the steel sheet. However, since it is an effective element that has an effect of suppressing phase transformation and can increase an area ratio of bainitic ferrite while suppressing ferrite transformation as much as possible under appropriate cooling step conditions, it is preferable to incorporate B as necessary. Therefore, an amount of B is preferably 0.0001% or more.

On the other hand, when the amount of B is more than 0.0030%, precipitates such as BN are easily generated, and the effect is saturated. Thus, the amount of B is set to 0.0030% or less. The amount of B is preferably 0.0020% or less. B has a very strong effect of suppressing phase transformation, and the amount of B is more preferably less than 0.0005% from the viewpoint of setting a total area ratio of bainitic ferrite and ferrite to 80% or more and less than 90%.

Total of one or more of Nb, Mo, and V: from 0 to 0.040%

Niobium (Nb), molybdenum (Mo), and vanadium (V) are optional elements optionally contained in the steel sheet. Nb, Mo, and V are elements that precipitate carbide in the ferrite crystal grains similarly to Ti, but an alloy cost is high and a precipitation strengthening ability is smaller than that of Ti. Therefore, one or more of Nb, Mo, and V may be contained, and a total content thereof is set to from 0 to 0.040%.

On the other hand, Nb and V are elements effective for strengthening the steel sheet by delaying recrystallization during hot rolling and refining crystal grains of the steel sheet. Mo is an element for improving hardenability, and is also an effective element for increasing the area ratio of bainitic ferrite while suppressing ferrite transformation as much as possible. In order to sufficiently obtain these effects, a total content of Nb, Mo, and Vis preferably 0.01% or more.

In the steel sheet, these elements are combined with TiC precipitates and exist as (Ti, M) C. Here, M is one or more of Nb, V, and Mo.

Total of one or more of Ca and REM: from 0 to 0.010%

Calcium (Ca) and REM are optional elements optionally contained in the steel sheet. Ca and REM are elements having a function of controlling the form of inclusions which become a starting point of fracture and cause deterioration of workability to detoxify the inclusions.

One or more of Ca and REM may be contained, and a total content thereof is set to from 0 to 0.01% or less.

On the other hand, in order to sufficiently obtain the effect of controlling the form of inclusions to detoxify the inclusions, the total content of one or more of calcium (Ca) and REM is preferably 0.0005% or more.

Note that REM refers to a total of 17 elements of Sc, Y, and lanthanoids. A content of the REM means a total content of at least one of these elements. In the case of lanthanoids, lanthanoids are industrially added in the form of misch metal.

Balance: Iron (Fe) and Impurities

The impurities refer to components contained in a raw material or components mixed in the course of manufacture and not intentionally incorporated in the steel sheet. Examples of the impurities include nickel (Ni), copper (Cu), and tin (Sn), which may be mixed from scraps. Contents of the impurities such as Ni, Cu, and Sn are each preferably 0.01% or less.

(Mass Ratio [Ti]/[C] of Ti Amount to C Amount)

A mass ratio [Ti]/[C] of the Ti amount to the C amount is from 0.16 to 3.00.

It is important that the mass ratio [Ti]/[C] of the Ti amount to the C amount is 3.00 or less. This value corresponds to a ratio of the numbers of Ti atoms/the numbers of C atoms of about 0.75 or less in terms of the ratio of the number of atoms. In conventional precipitation-strengthened steel sheets, an excessive amount of Ti is incorporated relative to the amount of C in order to precipitate TiC precipitates. However, in order to allow Ti to exist, in the steel sheet, not as a solid solution Ti atom but as a TiC precipitate as much as possible and to effectively contribute to precipitation strengthening, it is necessary to prevent the amount of Ti from being excessive with respect to the amount of C. In addition, when the mass ratio [Ti]/[C] exceeds 3.00 and TiC precipitates are sufficiently precipitated, the amount of C segregated into crystal grain boundaries is reduced, and the punched edge of the steel sheet is likely to be damaged. A more preferable upper limit of the mass ratio [Ti]/[C] is 2.50 or less.

On the other hand, since the lower limit value of the Ti amount is 0.040% and the upper limit value of the C amount is 0.250%, the lower limit value of the mass ratio [Ti]/[C] is 0.16 or more. A more preferable lower limit value of the mass ratio [Ti]/[C] is 0.46 or more.

(Product [Ti]×[C] of Ti Amount and C Amount)

A product [Ti]×[C] of the Ti amount and the C amount is from 0.0015 to 0.0160. When [Ti]×[C] is less than 0.0015, the degree of supercooling for precipitation of TiC is insufficient. Then, the content of Ti present as TiC precipitates precipitated in the matrix cannot be increased, and the strength increasing effect is reduced. On the other hand, when [Ti]×[C] is larger than 0.0160, the TiC precipitates cannot be completely dissolved in solutionization in the austenite region, and a precipitation strengthening amount corresponding to the added amount cannot be obtained in fine precipitation after phase transformation.

The product [Ti]×[C] of the Ti amount and the C amount is preferably from 0.0020 to 0.0150.

(Microstructure)

Next, the microstructure of the high-strength hot-rolled steel sheet according to the present embodiment will be described.

—Total Area Ratio of Bainitic Ferrite and Ferrite—

The high-strength hot-rolled steel sheet according to the present embodiment contains at least bainitic ferrite. In addition, the total area ratio of bainitic ferrite and ferrite is 70% or more with respect to the entire structure.

When the total area ratio of bainitic ferrite and ferrite is less than 70% with respect to the entire structure, workability may deteriorate, and the punched edge may be damaged.

The total area ratio of bainitic ferrite and ferrite is more preferably 80% or more with respect to the entire structure.

On the other hand, when the total area ratio of bainitic ferrite and ferrite is 90% or more with respect to the entire structure, it is difficult to obtain high strength, and thus the total area ratio of bainitic ferrite and ferrite is less than 90%. From the viewpoint of increasing the strength of the steel sheet, the total area ratio of bainitic ferrite and ferrite is preferably 88% or less, more preferably 86% or less, and still more preferably 85% or less.

—Area Ratio of Bainitic Ferrite—

In the high-strength hot-rolled steel sheet according to the present embodiment, an area ratio of bainitic ferrite with respect to the entire structure is preferably 50% or more, more preferably 55% or more, and still more preferably 60% or more.

In the high-strength hot-rolled steel sheet according to the present embodiment, the area ratio of bainitic ferrite with respect to the entire structure is preferably less than 90%, more preferably 88% or less, still more preferably 86% or less, and particularly preferably 85% or less.

By setting the area ratio of bainitic ferrite within the above range, the dislocation density of the steel sheet tends to fall within a desired range, and dislocation strengthening is more efficiently developed. Therefore, the steel sheet has higher tensile strength and is less likely to be damaged at the punched edge during punching, which is preferable.

—Area Ratio of Polygonal Ferrite—

In the high-strength hot-rolled steel sheet according to the present embodiment, the area ratio of polygonal ferrite with respect to the entire structure is preferably 0% or more and 40% or less, more preferably 0% or more and 35% or less, and still more preferably 0% or more and 30% or less.

When the area ratio of polygonal ferrite is within the above range, a steel sheet having higher tensile strength is obtained, which is preferable.

—Total Area Ratio of Martensite and Retained Austenite—

The high-strength hot-rolled steel sheet according to the present embodiment contains at least one of martensite or retained austenite.

A total area ratio of martensite and retained austenite is 5% or more with respect to the entire structure. When the total area ratio of martensite and retained austenite with respect to the entire structure is less than 5%, it is difficult to obtain high strength. Therefore, the total area ratio of martensite and retained austenite is 5% or more.

On the other hand, when the total area ratio of martensite and retained austenite with respect to the entire structure is more than 30%, the enrichment of carbon in martensite may be insufficient, and the contribution to the improvement in strength may be weakened. Therefore, the total area ratio of martensite and retained austenite is 30% or less.

The total area ratio of martensite and retained austenite with respect to the entire structure is more preferably 20% or less from the viewpoint of suppressing damage to the punched edge.

The observation of the microstructure is performed by mirror-polishing a sample, subjecting the sample to nital etching, and observing the microstructure at a position of ¼ of a sheet thickness in a plate thickness direction from its surface with an optical microscope.

Here, the area ratio is measured by the following method.

First, a test piece cut out so as to obtain a cross section parallel to a rolling direction and the sheet thickness direction of the steel sheet is mirror-polished, etched with a nital solution, and a microstructure at a position of ¼ of the sheet thickness is observed with an optical microscope. Martensite, retained austenite, and pearlite are recognized, the area ratios of martensite, retained austenite, and pearlite are measured by a point count method, and the total area ratio of martensite and retained austenite is determined from the results. A value obtained by subtracting the area ratios of martensite, retained austenite, and pearlite from 100% is defined as the total area ratio of bainitic ferrite and ferrite.

Next, for the measurement of the area ratio of ferrite, a further electropolished test piece is used. Subsequently, using the EBSP-OIM™ (Electron Back Scatter Diffraction Pattern-Orientation Imaging Microscopy) method, EBSP measurement is performed under the measurement conditions of a magnification of 2000 times, an area of 40 μm×80 μm, and a measurement step of 0.1 μm.

The EBSP-OIM™ method includes an apparatus and software to irradiate a highly inclined sample with an electron beam in a scanning electron microscope (SEM), photograph a Kikuchi pattern formed by backscattering with a highly sensitive camera, and perform computer image processing to measure a crystal orientation at an irradiation point in a short time. In the EBSP measurement, the crystal orientation on a surface of a bulk sample can be quantitatively analyzed, and an analysis area is a region that can be observed by the SEM. Measurement is performed over several hours, and regions to be analyzed are mapped at tens of thousands of points in a grid shape at equal intervals, so that the crystal orientation distribution in the sample can be known.

From the measurement results, the area ratio of ferrite is determined using the Kernel Average Misorientation (KAM) method. The Kernel Average Misorientation (KAM) method averages misorientation among six adjacent pixels of a certain pixel in the measurement data and performs calculation for each pixel using the value as a value of the central pixel. By performing this calculation so as not to exceed the crystal grain boundaries, it is possible to create a map representing an orientation change in crystal grains. That is, this map represents the distribution of strain based on a local orientation change in the crystal grains. Since ferrite undergoes diffusional transformation and has small transformation strain, crystal grains in which the average of misorientation between the six pixels and the central pixel is 1° or less as determined by the KAM method are defined here as ferrite, and the area ratio thereof is determined. The case where the misorientation between adjacent measurement points was 15° or more was defined as crystal grain boundary.

The area ratio of bainitic ferrite with respect to the entire structure is calculated from the difference between the total area ratio of bainitic ferrite and ferrite and the area ratio of ferrite.

The area ratio of polygonal ferrite to the entire structure is measured as follows.

Polygonal ferrite is characterized by having a low dislocation density and a particularly small misorientation over the entire region in the crystal grains. Therefore, in the present embodiment, first, the average value ×1 of the misorientation between the six pixels and the central pixel as determined by the KAM method is obtained for each measurement point; further, the average value ×2 at all the measurement points in the crystal grains is obtained from the average value ×1 obtained at each measurement point; and the crystal grains in which the ×2 value is 0.5° or less are defined as polygonal ferrite, and the area ratio thereof is determined. In the ferrite, a region that is not determined to be polygonal ferrite is ferrite having a relatively high dislocation density, such as acicular ferrite.

—Mean Dislocation Density—

The high-strength hot-rolled steel sheet according to the present embodiment has a mean dislocation density of from $1\times10^{14}$ to $1\times10^{16}$ $m^{-2}$ When the mean dislocation density is $1\times10^{14}$ $m^{-2}$ or more, dislocation strengthening is obtained.

On the other hand, when the mean dislocation density exceeds $1\times10^{16}$ $m^{-2}$, recrystallization is likely to occur, and the strength is significantly reduced.

The mean dislocation density is more preferably from $2\times10^{14}$ to $2\times10^{15}$ $m^{-2}$ A method of measuring the mean dislocation density is as follows.

For the measurement of the mean dislocation density, X-ray diffraction is used, and measurement is made by mirror-polishing a sample so that a surface at a position of ¼ of the sheet thickness is horizontal to the sheet surface (rolled surface).

From the strain measured by the X-ray diffraction, a mean dislocation density ρ is determined by the following equation described in Non-Patent Document 1.

$$\rho=14.4\ \varepsilon^2/b^2 \qquad \text{Equation:}$$

wherein ε is a strain obtained from the X-ray diffraction measurement, and b is a Burgers vector (0.25 nm).

—Mean Number Density of TiC Precipitate in Crystal Grain—

In the high-strength hot-rolled steel sheet according to the present embodiment, the mean number density of TiC precipitates is from $1\times10^{17}$ to $5\times10^{18}$ [precipitates/cm$^3$] in the ferrite crystal grains and in the bainitic ferrite crystal grains.

The mean number density of the TiC precipitates precipitated in the crystal grains is preferably high in order to utilize precipitation strengthening. Therefore, in order to obtain dislocation strengthening and precipitation strengthening to achieve a tensile strength of 850 MPa or more, the mean number density of TiC precipitates in the ferrite crystal grains and the bainitic ferrite crystal grains is from $1\times10^{17}$ to $5\times10^{18}$ [precipitates/cm$^3$], and preferably from $2\times10^{17}$ [precipitates/cm$^3$] to $5\times10^{18}$ [precipitates/cm$^3$].

The mean number density of TiC precipitates is measured by a three-dimensional atom probe measurement method as follows.

First, a needle-shaped sample is prepared from a sample to be measured by a cutting and electropolishing method, using a focused ion beam working method together with an electropolishing method as necessary, and three-dimensional atom probe measurement is performed on the needle-shaped sample. In the three-dimensional atom probe measurement, integrated data is reconstructed to obtain an actual atom distribution image in a real space.

Then, the formation position of the TiC precipitates in the needle-shaped sample is confirmed, and the number density of the TiC precipitates precipitated in the crystal grains in the ferrite crystal grains and the bainitic ferrite crystal grains is determined from the volume of the entire stereoscopic distribution image including the TiC precipitates and the number of the TiC precipitates. An average value obtained by performing this operation five times is defined as "mean number density of TiC precipitates precipitated in the crystal grains".

An average diameter of the TiC precipitates precipitated in the crystal grains is preferably 0.8 nm or more from the viewpoint of increasing the precipitation strengthening amount. On the other hand, when the average diameter is too large, the mean number density tends to decrease, and the precipitation strengthening amount decreases, which is not preferable. However, since it is essential that the mean number density be within the above range in order to increase the precipitation strengthening amount, the upper limit of the average diameter is not defined.

The average diameter of the TiC precipitates precipitated in the crystal grains is a diameter (spherical equivalent diameter) calculated, on the assumption that the TiC precipitates are spherical, from the number of constituent atoms of the observed TiC precipitates and the lattice constant of TiC. The diameters of 30 or more TiC precipitates are arbitrarily measured, and an average value thereof is determined.

—Amount of Ti Existing as TiC Precipitates Precipitated in Matrix—

In the high-strength hot-rolled steel sheet according to the present embodiment, the amount of Ti present as TiC precipitates precipitated in the matrix not on dislocations (that is, the amount of Ti contained in the TiC precipitates) is 30 mass % or more of the total amount of Ti in the steel sheet.

By setting the amount of Ti present as TiC precipitates precipitated in the matrix that is not on dislocations to 30 mass % or more of the total amount of Ti in the steel sheet, the ratio of TiC precipitates precipitated in the matrix can be increased, both precipitation strengthening and dislocation strengthening can be greatly developed, and a steel sheet having high tensile strength can be obtained while reducing the amount of Ti.

It is more preferable that the amount of Ti present as TiC precipitates precipitated in the matrix not on dislocations be 40% or more of the total amount of Ti in the steel sheet.

On the other hand, the amount of Ti present as TiC precipitates precipitated in the matrix not on dislocations is preferably as high as possible, but it is difficult to prevent coarsening of the precipitates in terms of the manufacturing process. Thus, the amount of Ti is preferably 90 mass % or less of the total amount of Ti in the steel sheet.

The amount of Ti present as TiC precipitates precipitated in the matrix not on dislocations is measured by the three-dimensional atom probe measurement method as follows.

First, the three-dimensional atom probe measurement is performed in the same procedure as the method of measuring the mean number density described above, and the formation position of the TiC precipitate is confirmed.

From the steric configuration of the TiC precipitates, when the TiC precipitates are arranged in a row, the TiC precipitates are determined to be those precipitated on dislocations, and, when the TiC precipitates are arranged independently, the TiC precipitates are determined to be those precipitated in the matrix that is not on the dislocations.

Figure 1B:
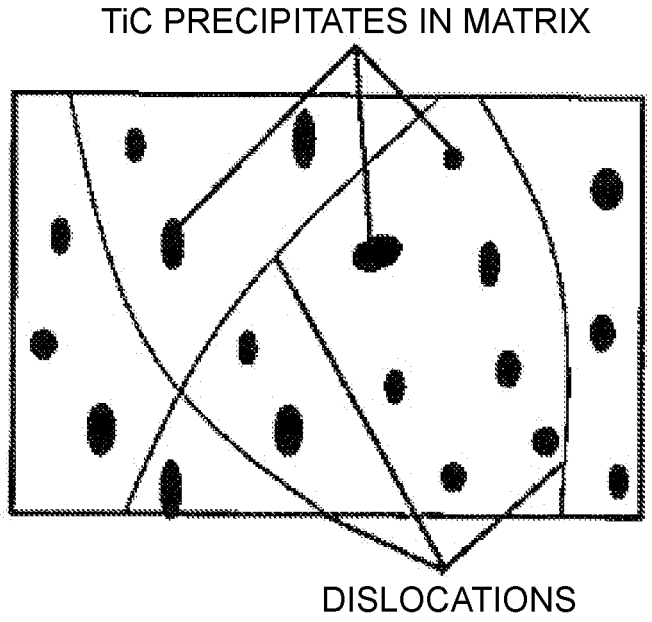
FIG. 1B shows a schematic diagram of an arrangement of TiC precipitates on a matrix.

FIG. 1A shows a schematic diagram of an arrangement of TiC precipitates precipitated on dislocations, and FIG. 1B shows a schematic diagram of an arrangement of TiC precipitates precipitated in the matrix not on the dislocations. In addition, there is also a case where both of (A) TiC precipitates precipitated on dislocations and (B) TiC precipitates precipitated in a matrix not on the dislocations are included in the same crystal grain, and thus it is determined to which of (A) and (B) each precipitate corresponds. The amount of Ti present as TiC precipitate precipitated in the matrix not on dislocations (mass ratio with respect to the total amount of Ti in the steel sheet) was calculated from the volume of the entire stereoscopic distribution image of the TiC precipitates, the number of Ti atoms constituting the TiC precipitates precipitated in the matrix not on dislocations, and the Ti content of the steel sheet.

In the tables and figures, this Ti amount is referred to as "matrix-precipitated Ti ratio".

The "TiC precipitates" include not only carbides but also carbonitrides in which nitrogen is mixed in carbides. The "TiC precipitates" also include precipitates in which one or more of Nb, Mo, and V are dissolved as a solid solution in the TiC precipitates ((Ti, M) C precipitates [M represents one or more of Nb, V, and Mo]).

—Tensile Strength—

A tensile strength of the high-strength hot-rolled steel sheet according to the present embodiment is 850 MPa or more.

The tensile strength of the high-strength hot-rolled steel sheet according to the present embodiment is 860 MPa or more.

However, from the viewpoint of preventing deterioration in workability, the tensile strength of the high-strength hot-rolled steel sheet according to the present embodiment may be, for example, 1050 MPa or less.

The tensile strength is measured as follows.

First, a No. 5 test piece is taken from the steel sheet in accordance with JIS Z 2201:1998. Subsequently, a tensile test is performed in accordance with JIS Z 2241:2011, and the tensile strength is measured.

(Manufacture Method)

Next, an example of a method of manufacturing the high-strength hot-rolled steel sheet according to the present embodiment will be described.

The method of manufacturing the high-strength hot-rolled steel sheet according to the present embodiment includes, for example, a hot rolling step of heating a steel piece that satisfies the chemical composition of the high-strength hot-rolled steel sheet according to the present embodiment for hot rolling thereof to obtain a steel sheet; a cooling step of cooling the steel sheet obtained through the hot rolling step; and a winding step of winding the cooled steel sheet.

(Hot Rolling Step)

In the hot rolling step, a steel piece that satisfies the chemical composition of the high-strength hot-rolled steel sheet according to the present embodiment is subjected to, for example, hot rolling through rough rolling and finish rolling to obtain a hot-rolled steel sheet.

As the steel piece, a steel piece obtained by melting and casting steel by a conventional method is used. The steel piece is preferably manufactured by a continuous casting facility from the viewpoint of productivity.

A heating temperature in the hot rolling is preferably 1200° C. or higher, and more preferably 1220° C. or higher in order to sufficiently decompose and dissolve Ti and carbon in the steel sheet. On the other hand, it is not economically preferable to set the heating temperature to an excessively high temperature, and thus it is preferable to set the heating temperature to 1300° C. or lower.

After casting, the steel piece may be cooled to 1200° C. or lower and then heated to a temperature of 1200° C. or higher to start rolling. When a steel piece cooled to 1200° C. or lower is used, it is preferable to heat the steel piece to a temperature of 1200° C. or higher and hold the steel piece for 1 hour or more.

A final working temperature FT [° C.] of hot rolling is preferably 920° C. or higher, and more preferably 940° C. or higher. This is intended to suppress the generation of coarse TIC precipitates in austenite and to promote the recovery of dislocations by working to suppress the nucleation of polygonal ferrite during cooling. The final working temperature FT [° C.] of hot rolling is more preferably 950° C. or higher in order to suppress precipitation of TiC precipitates at a high temperature. Here, in order to suppress nucleation of polygonal ferrite, the final working temperature FT [° C.] is more preferably 940° C. or higher, but may be 920° C. or higher and lower than 940° C. when the Mn amount is 0.35% or more.

However, from the viewpoint of suppressing the occurrence of scale defects, the final working temperature FT [° C.] is preferably 1050° C. or lower.

The final working temperature FT indicates a temperature at which the hot-rolled rolled sheet is discharged from the final stand.

(Cooling Step)

In the cooling step, the hot-rolled steel sheet is subjected to primary cooling, secondary cooling, and tertiary cooling.

—Primary Cooling—

In the primary cooling, cooling is performed at an average cooling rate of 30° C./s or more from the end of the hot rolling step to a primary cooling stop temperature MT [° C.].

The primary cooling stop temperature MT [° C.] is set within a range of from 620 to 720° C.

The primary cooling is preferably started within 5.0 seconds after the end of the hot rolling step. If this time exceeds 5.0 seconds, precipitation of TiC precipitates in austenite may proceed, so that effective precipitation in bainitic ferrite and ferrite may be reduced.

The average cooling rate of the primary cooling is preferably 30° C./s or more. This is intended to suppress ferrite transformation during cooling to suppress a decrease in mean dislocation density and to suppress a decrease in number density accompanying coarsening of TiC precipitates after phase transformation.

The cooling rate of the primary cooling is more preferably 35° C./s or more.

An upper limit of the cooling rate of the primary cooling is not particularly limited, but is preferably 300° C./s or less in view of the capacity of the cooling facility.

The average cooling rate in a range from the primary cooling stop temperature MT [° C.]+50° C. to the primary cooling stop temperature MT [° C.] is preferably 50° C./s or more. The reason is as follows.

Through phase transformation during the secondary cooling after the primary cooling, the mean number density of the TiC precipitates can be set to from $1\times10^{17}$ to $5\times10^{18}$ [precipitates/$cm^3$] while increasing the mean dislocation density. In the primary cooling, as the temperature approaches the primary cooling stop temperature MT [° C.], the driving force of the phase transformation increases. Therefore, when the cooling rate in the range decreases, the phase transformation starts before the secondary cooling, so that the mean dislocation density, the mean number density of precipitates, and the matrix-precipitated Ti ratio decrease. In order to set the total area ratio of ferrite and bainitic ferrite, which is a more preferable form of the high-strength hot-rolled steel sheet according to the present embodiment, to 80% or more, the content of B is preferably less than 0.0005%. However, when the content of B is less than 0.0005%, the effect of suppressing the ferrite transformation is not so strong, and therefore the phase transformation may start immediately before the stop of the primary cooling. Therefore, the average cooling rate in the range from the primary cooling stop temperature MT [° C.]+50° C. to the primary cooling stop temperature MT [° C.] is preferably increased to 50° C./s or more. This is not necessary when the content of B is from 0.0005 to 0.0030%.

The average cooling rate in the range from the primary cooling stop temperature MT [° C.]+50° C. to the primary cooling stop temperature is more preferably 60° C./s or more.

The average cooling rate in the range from the primary cooling stop temperature MT [° C.]+50° C. to the primary cooling stop temperature is more preferably 300° C./s or less.

The upper limit of the average cooling rate in a range from the start of the primary cooling to the primary cooling stop temperature MT [° C.]+50° C. is not particularly limited, however, preferably 25° C./s or more, more preferably 30° C./s or more, and still more preferably 35° C./s or more.

The average cooling rate in the range from the start of the primary cooling to the primary cooling stop temperature MT [° C.]+50° C. is more preferably 300° C./s or less in view of the capacity of the cooling facility.

The average cooling rate in the range from the primary cooling stop temperature MT [° C.]+50° C. to the primary cooling stop temperature is preferably higher than the average cooling rate in the range from the start of the primary cooling to the primary cooling stop temperature MT [° C.]+50° C. This is because nucleation of polygonal ferrite can be suppressed, the area ratio of polygonal ferrite can be reduced, and the total area ratio of bainitic ferrite and ferrite can be easily set within a range of 70% or more and less than 90%.

However, when the conditions are satisfied that the average cooling rate of the primary cooling is 30° C./s or more, that the average cooling rate in the range from the primary cooling stop temperature MT [° C.]+50° C. to the primary cooling stop temperature MT [C] is 50° C./s or more, and that the average cooling rate in the range from the start of the primary cooling to the primary cooling stop temperature MT [° C.]+50° C. is 25° C./s or more, the average cooling rate in the range from the primary cooling stop temperature MT [° C.]+50° C. to the primary cooling stop temperature MT [° C.] may be lower than the average cooling rate in the range from the start of the primary cooling to the primary cooling stop temperature MT [° C.]+50° C. In this case, however, a difference between the average cooling rate in the range from the primary cooling stop temperature MT [° C.]+50° C. to the primary cooling stop temperature and the average cooling rate in the range from the start of the primary cooling to the primary cooling stop temperature MT [° C.]+50° C. is preferably within a range of 15° C./s or less. This can suppress nucleation of polygonal ferrite, reduce the area ratio of polygonal ferrite, and easily set the total area ratio of bainitic ferrite and ferrite within the range of 70% or more and less than 90%.

By setting the cooling rate in the primary cooling and the stop temperature of the primary cooling within the above ranges, nucleation of polygonal ferrite can be suppressed, and the area ratio of polygonal ferrite can be reduced. By setting the cooling rate in the primary cooling within the above range, the total area ratio of bainitic ferrite and ferrite can be easily set within the range of 70% or more and less than 90%.

The stop temperature MT [° C.] of the primary cooling is preferably from 620° C. to 720° C. in order to increase the mean dislocation density associated with the phase transformation, the ratio at which the TiC precipitates precipitate in the matrix after the phase transformation (matrix not on dislocations), and the number density of the TiC precipitates.

When the stop temperature MT [° C.] of the primary cooling exceeds 720° C., precipitation of TiC precipitates on dislocations is promoted, so that the size of the TIC precipitates increases, and that the number density of the TiC precipitates decreases.

On the other hand, when the stop temperature MT [° C.] of the primary cooling is lower than 620° C., precipitation of TiC precipitates becomes insufficient, so that the number density of TiC precipitates decreases.

—Secondary Cooling—

In the secondary cooling, cooling is performed at a cooling rate of 5° C./s or less for from 3 to 10 seconds after completion of the primary cooling.

The secondary cooling is preferably performed at a cooling rate of 5° C./s or less in order to promote phase transformation and precipitation of TiC precipitates.

The secondary cooling is preferably performed by air cooling from the viewpoint of manufacturing cost.

A cooling time of the secondary cooling is preferably from 3 to 10 seconds.

When the cooling time of the secondary cooling is less than 3 seconds, the phase transformation becomes insufficient, and the total area ratio of bainitic ferrite and ferrite cannot be set to 70% or more.

The cooling time of the secondary cooling is more preferably 4 seconds or more.

On the other hand, when the cooling time of the secondary cooling exceeds 10 seconds, the TiC precipitates become coarse and the number density decreases, and, additionally, the total area ratio of ferrite and bainitic ferrite may be 90% or more. Thus, it is preferable to set the cooling time to 10 seconds or less.

The cooling time of the secondary cooling is more preferably 8 seconds or less.

The cooling time of the secondary cooling is preferably from 4 to 8 seconds.

—Tertiary Cooling—

The tertiary cooling is a step of cooling to a stop temperature CT [° C.] of lower than 500° C. at a cooling rate of 30° C./s or more after completion of the secondary cooling.

A cooling rate of the tertiary cooling is preferably 30° C./s or more.

This is intended to prevent a decrease in number density due to coarsening of the TiC precipitates generated during secondary cooling, and to set the total area ratio of ferrite and bainitic ferrite to less than 90%.

The cooling rate of the tertiary cooling is more preferably 35° C./s or more.

An upper limit of the cooling rate of the tertiary cooling is not particularly limited, but is preferably 200° C./s or less in view of the capacity of the cooling facility.

A stop temperature CT [° C.] of the tertiary cooling is preferably lower than 500° C. in order to set the area ratio of ferrite and bainitic ferrite lower than 90%.

When the stop temperature CT [° C.] of the tertiary cooling is 500° C. or higher, the total area ratio of ferrite and bainitic ferrite increases, and it becomes difficult to obtain a desired tensile strength.

The stop temperature CT [° C.] of the tertiary cooling is preferably room temperature or higher from the viewpoint of ease of manufacture.

(Winding Step)

In the winding step, the cooled steel sheet is wound. The winding of the steel sheet is not particularly limited, and may be performed according to a conventional method.

(Other Steps)

The wound steel sheet may be subjected to well-known treatments such as 1) skin pass rolling for the purpose of improving ductility by straightening the shape of the steel sheet and introducing moving dislocations, 2) pickling for the purpose of removing scale adhering to the surface of the steel sheet, and 3) plating.

(Intended Use)

The high-strength hot-rolled steel sheet according to the present embodiment can be applied to various members such as automobile parts that are required to have a tensile strength of 850 MPa or more.

EXAMPLES

Hereinafter, preferred embodiments of the present disclosure will be described more specifically with reference to Examples. However, the embodiments do not limit the present disclosure.

Steels having the component compositions shown in Table 1 were melted and cast. The component values in Table 1 are chemical analysis values expressed in mass %.

Next, steel pieces were hot-rolled under the manufacture conditions shown in Table 2, and then the obtained hot-rolled sheets were cooled and wound to manufacture hot-rolled steel sheets.

Using the obtained hot-rolled steel sheets, the presence or absence of punched edge damage was evaluated.

With respect to the presence or absence of punched edge damage, the obtained hot-rolled steel sheets were punched with a clearance of 20% according to the method described in the Japan Iron and Steel Federation standard JFS T 1001-1996, and the punched edge was visually observed to examine the presence or absence of damage. When the ratio of the damaged portion to the punched circumference was 30% or more, it was evaluated as occurrence of damage (C (x)); when the ratio was 10% or more and less than 30%, it was evaluated as preferable (B (○)); and when the ratio was less than 10%, it was evaluated as more preferable (A (⊙)).

In addition, for the obtained hot-rolled steel sheets, the area ratio of bainitic ferrite and ferrite, the area ratio of bainitic ferrite, the area ratio of polygonal ferrite, the total area ratio of martensite and retained austenite, the mean dislocation density, the average diameter of TiC precipitates in crystal grains, the mean number density of TiC precipitates in crystal grains, the amount of Ti present as TiC precipitates precipitated in a matrix not on dislocations (the amount of Ti with respect to the total amount of Ti in the steel sheet), and the tensile strength were measured according to the methods described above.

The evaluation results are shown in Table 3.

In Table 1, "-" means that the component is not intentionally added.

Underlines in Tables 1 to 3 mean that the underlined values are outside the scope of the preferred embodiments of the present disclosure.

The details of the abbreviations in Tables 2 and 3 are as follows.

End temperature of hot rolling: final working temperature FT [° C.]

MT of primary cooling: stop temperature MT [° C.] of primary cooling

CT of tertiary cooling: stop temperature CT [° C.] of tertiary cooling

Diameter of TiC precipitates: average diameter of TiC precipitates in ferrite crystal grains and bainitic ferrite crystal grains Density of TiC precipitates: mean number density of TiC precipitates in ferrite crystal grains and bainitic ferrite crystal grains matrix-precipitated Ti ratio: percent ratio obtained by dividing amount of Ti present as TiC precipitates precipitated in matrix not on dislocations by amount of Ti in steel sheet Area ratio of bainitic ferrite and ferrite: total area ratio of bainitic ferrite and ferrite Area ratio of martensite and retained austenite: total area ratio of martensite and retained austenite Dislocation density: mean dislocation density

TABLE 1

| Steel | Chemical composition (mass %): balance = Fe + impurities | | | | | | | | | | | | | | | | [Ti]/ | [Ti] × | |
|---|---|---|---|---|---|---|---|---|---|---|---|---|---|---|---|---|---|---|---|
| No. | C | Si | Mn | Ti | P | S | Al | N | B | Nb | Mo | V | Ca | REM | Cr | W | [C] | [C] | Remarks |
| A | 0.120 | 1.00 | 1.6 | 0.091 | 0.009 | 0.001 | 0.120 | 0.0040 | 0.0005 | — | — | — | — | — | — | 0.010 | 0.76 | 0.0109 | Example |
| B | 0.200 | 1.20 | 1.0 | 0.066 | 0.008 | 0.001 | 0.410 | 0.0030 | 0.0002 | — | — | — | — | — | 0.150 | — | 0.33 | 0.0132 | |
| C | 0.040 | 1.30 | 2.2 | 0.110 | 0.012 | 0.002 | 0.029 | 0.0043 | 0.0003 | — | — | — | — | — | — | — | 2.75 | 0.0044 | |
| D | 0.070 | 1.50 | 1.5 | 0.130 | 0.007 | 0.001 | 0.038 | 0.0031 | 0.0002 | — | — | — | — | — | — | — | 1.86 | 0.0091 | |
| E | 0.095 | 0.05 | 1.9 | 0.095 | 0.008 | 0.001 | 0.350 | 0.0024 | — | — | — | — | — | — | — | — | 1.00 | 0.0090 | |
| F | 0.065 | 1.10 | 1.8 | 0.170 | 0.008 | 0.002 | 0.110 | 0.0026 | 0.0009 | — | — | — | — | — | — | — | 2.62 | 0.0111 | |
| G | 0.130 | 1.00 | 0.5 | 0.120 | 0.007 | 0.001 | 0.120 | 0.0034 | 0.0012 | — | 0.030 | — | — | — | — | — | 0.92 | 0.0156 | |
| H | 0.036 | 0.75 | 2.5 | 0.048 | 0.008 | 0.001 | 0.260 | 0.0022 | 0.0022 | 0.030 | — | 0.010 | — | — | — | 0.020 | 1.33 | 0.0017 | |
| I | 0.030 | 1.20 | 1.8 | 0.040 | 0.007 | 0.001 | 0.040 | 0.0026 | 0.0005 | — | — | — | — | — | — | — | 1.33 | 0.0012 | Compar- |
| J | 0.025 | 1.50 | 1.6 | 0.130 | 0.007 | 0.002 | 0.035 | 0.0024 | 0.0009 | — | — | — | — | — | — | — | 5.20 | 0.0033 | ative |
| K | 0.054 | 0.95 | 1.7 | 0.025 | 0.008 | 0.001 | 0.400 | 0.0036 | 0.0005 | — | 0.030 | 0.010 | — | — | — | — | 0.46 | 0.0014 | Example |
| L | 0.040 | 0.05 | 1.2 | 0.150 | 0.007 | 0.001 | 0.032 | 0.0038 | 0.0012 | — | — | — | — | — | — | — | 3.75 | 0.0060 | |
| M | 0.200 | 0.80 | 1.0 | 0.090 | 0.009 | 0.001 | 0.035 | 0.0031 | — | — | — | — | — | — | — | — | 0.45 | 0.0180 | |
| N | 0.080 | 1.10 | 1.5 | 0.190 | 0.010 | 0.001 | 0.030 | 0.0045 | 0.0004 | — | — | — | 0.002 | 0.003 | — | — | 2.38 | 0.0152 | Example |
| O | 0.250 | 0.70 | 0.9 | 0.040 | 0.009 | 0.001 | 0.230 | 0.0023 | — | 0.020 | — | 0.020 | — | — | — | — | 0.16 | 0.0100 | Example |
| P | 0.040 | 1.30 | 3.0 | 0.080 | 0.020 | 0.002 | 0.032 | 0.0024 | 0.0006 | — | — | — | — | — | — | — | 2.00 | 0.0032 | Example |
| Q | 0.120 | 1.20 | 1.8 | 0.130 | 0.100 | 0.001 | 0.290 | 0.0042 | — | — | — | — | — | — | — | — | 1.08 | 0.0156 | Example |
| R | 0.070 | 1.00 | 2.2 | 0.150 | 0.009 | 0.005 | 0.100 | 0.0032 | — | — | — | — | — | — | — | — | 2.14 | 0.0105 | Example |
| S | 0.075 | 0.50 | 1.6 | 0.200 | 0.008 | 0.001 | 0.340 | 0.0090 | — | — | — | — | — | — | — | — | 2.67 | 0.0150 | Example |
| T | 0.200 | 1.50 | 1.5 | 0.030 | 0.008 | 0.002 | 0.030 | 0.0035 | — | — | — | — | — | — | — | — | 0.15 | 0.0060 | Compar- ative Example |

Underlines mean that the underlined values are outside the scope of the preferred embodiments of the present invention.

"—" means that the component is not intentionally added.

TABLE 2-1

| | | Hot rolling | | | Primary cooling | | | | Secondary cooling | | Tertiary cooling | | |
|---|---|---|---|---|---|---|---|---|---|---|---|---|---|
| Test No | Steel No. | Heating temperature ° C. | End temperature ° C. | Start of cooling Time Second | Cooling rate ° C./s | Start of primary cooling to MT + 50 ° C./s | MT + 50 to MT cooling rate ° C./s | MT ° C. | Cooling rate ° C./s | Time Second | Cooling rate ° C./s | CT ° C. | Remarks |
| 1 | A | 1250 | 980 | 3.3 | 40 | 38 | 50 | 710 | 2 | 8 | 40 | 300 | Example |
| 2 | | 1220 | 950 | 5.0 | 20 | 22 | 15 | 700 | 3 | 5 | 30 | 350 | Comparative Example |
| 3 | B | 1240 | 970 | 2.2 | 40 | 38 | 50 | 720 | 3 | 7 | 70 | <100 | Example |
| 4 | | 1230 | 960 | 3.0 | 60 | 61 | 55 | 550 | 2 | 10 | 30 | 490 | Comparative Example |

TABLE 2-1-continued

| Test No | Steel No. | Hot rolling Heating temperature ° C. | Hot rolling End temperature ° C. | Primary cooling Start of cooling Time Second | Primary cooling Cooling rate ° C./s | Primary cooling Start of primary cooling to MT + 50 ° C./s | Primary cooling MT + 50 to MT cooling rate ° C./s | Primary cooling MT ° C. | Secondary cooling Cooling rate ° C./s | Secondary cooling Time Second | Tertiary cooling Cooling rate ° C./s | Tertiary cooling CT ° C. | Remarks |
|---|---|---|---|---|---|---|---|---|---|---|---|---|---|
| 5 | C | 1230 | 950 | 4.0 | 30 | 27 | 50 | 690 | 2 | 10 | 35 | 480 | Example |
| 6 | | 1250 | 960 | 1.8 | 50 | 50 | 50 | 720 | 3 | 6 | 30 | 550 | Comparative Example |
| 7 | | 1240 | 920 | 4.5 | 60 | 62 | 55 | 670 | 2 | 4 | 30 | 490 | Example |
| 8 | D | 1250 | 980 | 2.1 | 60 | 63 | 50 | 720 | 3 | 5 | 60 | <100 | Example |
| 9 | | 1220 | 910 | 2.9 | 35 | 32 | 50 | 700 | 3 | 6 | 30 | 480 | Comparative Example |
| 10 | E | 1230 | 970 | 0.3 | 50 | 48 | 60 | 690 | 4 | 6 | 50 | 450 | Example |
| 11 | | 1240 | 1010 | 3.3 | 60 | 61 | 55 | 630 | 3 | 3 | 50 | <100 | Example |
| 12 | | 1250 | 950 | 6.5 | 40 | 38 | 50 | 690 | 3 | 6 | 50 | 400 | Comparative Example |
| 13 | | 1240 | 960 | 0.5 | 35 | 33 | 45 | 720 | 3 | 6 | 100 | <100 | Comparative Example |
| 14 | F | 1270 | 990 | 1.3 | 40 | 39 | 50 | 650 | 2 | 4 | 40 | 460 | Example |
| 15 | | 1250 | 950 | 2.0 | 50 | 50 | 50 | 800 | 2 | 10 | 50 | 460 | Comparative Example |
| 16 | | 1250 | 970 | 1.0 | 60 | 63 | 50 | 700 | 2 | 8 | 10 | 480 | Comparative Example |
| 17 | | 1240 | 980 | 1.2 | 60 | 61 | 55 | 680 | 10 | 2 | 50 | 400 | Comparative Example |

Underlines mean that the underlined values are outside the scope of the preferred embodiments of the present invention.

TABLE 2-2

| Test No | Steel No. | Hot rolling Heating temperature ° C. | Hot rolling End temperature ° C. | Primary cooling Start of cooling Time Second | Primary cooling Cooling rate ° C./s | Primary cooling Start of primary cooling to MT + 50 ° C./s | Primary cooling MT + 50 to MT cooling rate ° C./s | Primary cooling MT ° C. | Secondary cooling Cooling rate ° C./s | Secondary cooling Time Second | Tertiary cooling Cooling rate ° C./s | Tertiary cooling CT ° C. | Remarks |
|---|---|---|---|---|---|---|---|---|---|---|---|---|---|
| 18 | G | 1280 | 990 | 4.0 | 40 | 39 | 50 | 650 | 3 | 6 | 60 | <100 | Example |
| 19 | | 1270 | 940 | 2.0 | 40 | 43 | 30 | 630 | 3 | 5 | 50 | 400 | Example |
| 20 | H | 1230 | 970 | 5.0 | 50 | 50 | 50 | 620 | 2 | 5 | 30 | 490 | Example |
| 21 | I | 1220 | 920 | 1.8 | 30 | 27 | 50 | 650 | 3 | 10 | 30 | 450 | Comparative Example |
| 22 | J | 1250 | 950 | 0.8 | 50 | 49 | 55 | 660 | 4 | 4 | 60 | <100 | Comparative Example |
| 23 | K | 1230 | 930 | 3.0 | 60 | 63 | 50 | 670 | 3 | 5 | 40 | 400 | Comparative Example |
| 24 | L | 1240 | 980 | 4.0 | 50 | 50 | 50 | 700 | 3 | 10 | 30 | 450 | Comparative Example |
| 25 | M | 1250 | 930 | 2.5 | 35 | 32 | 55 | 660 | 2 | 10 | 30 | 480 | Comparative Example |
| 26 | N | 1280 | 1050 | 3.5 | 40 | 39 | 50 | 720 | 3 | 5 | 50 | <100 | Example |
| 27 | O | 1260 | 990 | 2.0 | 40 | 39 | 50 | 670 | 3 | 8 | 30 | 400 | Example |
| 28 | P | 1230 | 930 | 3.0 | 45 | 44 | 50 | 630 | 3 | 9 | 40 | <100 | Example |
| 29 | Q | 1250 | 960 | 2.0 | 50 | 49 | 55 | 650 | 2 | 8 | 30 | 450 | Example |
| 30 | R | 1240 | 920 | 3.0 | 40 | 37 | 60 | 640 | 2 | 7 | 35 | 430 | Example |
| 31 | S | 1250 | 950 | 3.0 | 50 | 50 | 50 | 660 | 3 | 5 | 30 | 460 | Example |
| 32 | T | 1230 | 960 | 3.0 | 40 | 38 | 50 | 670 | 3 | 6 | 30 | 400 | Comparative Example |
| 33 | E | 1230 | 970 | 0.3 | 50 | 75 | 20 | 690 | 4 | 6 | 50 | 450 | Comparative Example |
| 34 | E | 1230 | 970 | 0.3 | 70 | 100 | 25 | 690 | 4 | 6 | 50 | 450 | Comparative Example |

Underlines mean that the underlined values are outside the scope of the preferred embodiments of the present invention.

TABLE 3-1

| Test No | Area ratio of bainitic ferrite and ferrite % | Area ratio of bainitic ferrite % | Area ratio of polygonal ferrite % | Total area ratio of martensite and retained austenite % | Dislocation density ρ $m^{-2}$ | TiC precipitate Diameter nm | TiC precipitate Density precipitates/$cm^3$ | TiC precipitate matrix-precipitated Ti ratio % | Tensile strength MPa | Punched edge damage | Remarks |
|---|---|---|---|---|---|---|---|---|---|---|---|
| 1 | 79 | 75 | 0 | 21 | $1 \times 10^{15}$ | 1.5 | $5 \times 10^{17}$ | 35 | 860 | B (○) | Example |
| 2 | 86 | 42 | 41 | 14 | $6 \times 10^{13}$ | 2.9 | $5 \times 10^{16}$ | 10 | 800 | A (⊙) | Comparative Example |
| 3 | 75 | 55 | 15 | 25 | $9 \times 10^{14}$ | 1.8 | $4 \times 10^{17}$ | 45 | 850 | B (○) | Example |
| 4 | 83 | 83 | 0 | 17 | $2 \times 10^{15}$ | 0.9 | $3 \times 10^{16}$ | 0 | 780 | B (○) | Comparative Example |
| 5 | 89 | 85 | 3 | 11 | $1 \times 10^{15}$ | 1.4 | $8 \times 10^{17}$ | 45 | 860 | A (⊙) | Example |
| 6 | 92 | 68 | 15 | 3 | $1 \times 10^{14}$ | 2.8 | $2 \times 10^{17}$ | 50 | 810 | A (⊙) | Comparative Example |
| 7 | 88 | 86 | 0 | 12 | $9 \times 10^{14}$ | 1.5 | $6 \times 10^{17}$ | 40 | 850 | A (⊙) | Example |
| 8 | 82 | 60 | 15 | 18 | $3 \times 10^{14}$ | 1.7 | $1 \times 10^{18}$ | 50 | 960 | A (⊙) | Example |
| 9 | 85 | 62 | 20 | 15 | $9 \times 10^{13}$ | 3.0 | $6 \times 10^{16}$ | 10 | 830 | A (⊙) | Comparative Example |
| 10 | 85 | 82 | 0 | 15 | $7 \times 10^{14}$ | 1.8 | $4 \times 10^{17}$ | 50 | 950 | A (⊙) | Example |
| 11 | 75 | 72 | 0 | 25 | $1 \times 10^{15}$ | 1.3 | $9 \times 10^{17}$ | 35 | 930 | B (○) | Example |
| 12 | 89 | 85 | 2 | 11 | $2 \times 10^{14}$ | 4.0 | $4 \times 10^{16}$ | 20 | 840 | A (⊙) | Comparative Example |
| 13 | 83 | 50 | 31 | 17 | $1 \times 10^{14}$ | 2.7 | $9 \times 10^{16}$ | 10 | 840 | A (⊙) | Comparative Example |
| 14 | 79 | 76 | 0 | 21 | $1 \times 10^{15}$ | 1.3 | $2 \times 10^{18}$ | 60 | 1010 | B (○) | Example |
| 15 | 85 | 15 | 60 | 15 | $6 \times 10^{13}$ | 5.1 | $5 \times 10^{16}$ | 0 | 810 | A (⊙) | Comparative Example |
| 16 | 87 | 54 | 10 | 13 | $1 \times 10^{14}$ | 4.2 | $8 \times 10^{16}$ | 40 | 830 | A (⊙) | Comparative Example |
| 17 | 52 | 50 | 0 | 48 | $3 \times 10^{15}$ | 1.2 | $5 \times 10^{16}$ | 0 | 830 | C (×) | Comparative Example |

Underlines mean that the underlined values are outside the scope of the preferred embodiments of the present invention.

TABLE 3-2

| Test No | Area ratio of bainitic ferrite and ferrite % | Area ratio of bainitic ferrite % | Area ratio of polygonal ferrite % | Total area ratio of martensite and retained austenite % | Dislocation density ρ $m^{-2}$ | TiC precipitate Diameter nm | TiC precipitate Density precipitates/$cm^3$ | TiC precipitate matrix-precipitated Ti ratio % | Tensile strength MPa | Punched edge damage | Remarks |
|---|---|---|---|---|---|---|---|---|---|---|---|
| 18 | 70 | 70 | 0 | 30 | $2 \times 10^{15}$ | 1.3 | $9 \times 10^{17}$ | 35 | 980 | B (○) | Example |
| 19 | 73 | 73 | 0 | 27 | $2 \times 10^{15}$ | 1.0 | $2 \times 10^{18}$ | 30 | 940 | B (○) | Example |
| 20 | 73 | 73 | 0 | 27 | $8 \times 10^{14}$ | 1.3 | $6 \times 10^{17}$ | 60 | 870 | B (○) | Example |
| 21 | 86 | 81 | 3 | 14 | $6 \times 10^{14}$ | 1.0 | $2 \times 10^{17}$ | 0 | 730 | A (⊙) | Comparative Example |
| 22 | 89 | 85 | 3 | 11 | $8 \times 10^{14}$ | 2.8 | $8 \times 10^{16}$ | 30 | 810 | C (×) | Comparative Example |
| 23 | 79 | 73 | 0 | 21 | $3 \times 10^{14}$ | 1.6 | $4 \times 10^{16}$ | 15 | 740 | B (○) | Comparative Example |
| 24 | 88 | 72 | 5 | 12 | $2 \times 10^{14}$ | 2.0 | $5 \times 10^{17}$ | 50 | 860 | C (×) | Comparative Example |
| 25 | 83 | 75 | 2 | 17 | $6 \times 10^{14}$ | 3.5 | $6 \times 10^{16}$ | 40 | 750 | A (⊙) | Comparative Example |
| 26 | 88 | 70 | 8 | 12 | $1 \times 10^{14}$ | 2.0 | $8 \times 10^{17}$ | 50 | 900 | A (⊙) | Example |
| 27 | 80 | 77 | 0 | 20 | $6 \times 10^{14}$ | 1.8 | $2 \times 10^{17}$ | 40 | 860 | B (○) | Example |
| 28 | 70 | 65 | 0 | 30 | $5 \times 10^{15}$ | 1.5 | $7 \times 10^{17}$ | 30 | 950 | B (○) | Example |
| 29 | 87 | 79 | 5 | 13 | $8 \times 10^{14}$ | 2.0 | $5 \times 10^{17}$ | 40 | 870 | A (⊙) | Example |
| 30 | 83 | 75 | 3 | 17 | $5 \times 10^{14}$ | 1.0 | $5 \times 10^{18}$ | 50 | 890 | A (⊙) | Example |
| 31 | 89 | 78 | 8 | 11 | $6 \times 10^{14}$ | 1.9 | $9 \times 10^{17}$ | 50 | 960 | A (⊙) | Example |
| 32 | 85 | 73 | 3 | 15 | $9 \times 10^{14}$ | 2.1 | $9 \times 10^{16}$ | 10 | 820 | A (⊙) | Comparative Example |
| 33 | 88 | 28 | 55 | 12 | $7 \times 10^{13}$ | 3.2 | $7 \times 10^{16}$ | 10 | 820 | A (⊙) | Comparative Example |
| 34 | 86 | 30 | 50 | 14 | $8 \times 10^{13}$ | 2.9 | $9 \times 10^{16}$ | 25 | 840 | A (⊙) | Comparative Example |

Underlines mean that the underlined values are outside the scope of the preferred embodiments of the present invention.

From the above results, Test Nos. 1, 3, 5, 7, 8, 10, 11, 14, 18, 19, 20, 26, 27, 28, 29, 30, and 31 are examples in which the chemical composition of, the microstructure of, and the manufacturing conditions for the steel sheet were within the scope of the preferred embodiments of the present disclosure. They had high strength, and had no damage at the punched edge.

On the other hand, Test No. 2 is an example in which the cooling rate of the primary cooling was low. This is an example in which the mean dislocation density, the mean number density of precipitates, the matrix-precipitated Ti ratio, and the tensile strength decreased with the phase transformation at a high temperature.

Test No. 4 is an example in which the stop temperature of the primary cooling was low. This is an example in which TiC precipitates were insufficiently precipitated, and the mean number density of precipitates, the matrix-precipitated Ti ratio, and the tensile strength decreased.

Test No. 6 is an example in which the stop temperature of the tertiary cooling was high. This is an example in which the total area ratio of ferrite and bainitic ferrite increased and the tensile strength decreased.

Test No. 9 is an example in which the end temperature of hot rolling was low. This is an example in which coarse TiC precipitates were precipitated in austenite, ferrite transformation was promoted at a high temperature, and the mean dislocation density, the mean number density of TiC precipitates, the matrix-precipitated Ti ratio, and the tensile strength decreased.

Test No. 12 is an example in which the cooling start time after hot rolling was long. This is an example in which precipitation of coarse TiC precipitates in austenite progressed, and the mean number density of TiC precipitates, the matrix-precipitated Ti ratio, and the tensile strength decreased.

Test No. 13 is an example in which the cooling rate in the range from [MT+50] ° C. to [MT] ° C. during primary cooling was low. This is an example in which precipitation of TiC precipitates on dislocations was promoted, and the mean number density, the matrix-precipitated Ti ratio, and the tensile strength decreased.

Test No. 15 is an example in which the primary cooling stop temperature was high. This is an example in which the mean dislocation density was low, and, additionally, precipitation of TiC precipitates on dislocations was promoted, and the matrix-precipitated Ti ratio, the mean number density of TiC precipitates, and the tensile strength decreased.

Test No. 16 is an example in which the cooling rate of the tertiary cooling was low. This is an example in which the mean number density of TiC precipitates and the tensile strength decreased.

Test No. 17 is an example in which the cooling rate of the secondary cooling was high and the cooling time was short. This is an example in which TiC precipitates were insufficiently precipitated, and the mean number density of precipitates, the matrix-precipitated Ti ratio, and the tensile strength decreased.

Test No. 21 is an example in which the value of [Ti]×[C] was smaller than 0.0015. This is an example in which the matrix-precipitated Ti ratio and the tensile strength decreased.

Test No. 22 is an example in which the C amount was small. The mean number density of TiC precipitates and the tensile strength decreased. In addition, this is an example in which the ratio of [Ti]/[C] was high and punched edge damage occurred.

Test No. 23 is an example in which the content of Ti was small and the value of [Ti]×[C] was smaller than 0.0015. This is an example in which the mean number density of TiC precipitates, the matrix-precipitated Ti ratio, and the tensile strength decreased.

Test No. 24 is an example in which the ratio of [Ti]/[C] was high. This is an example in which punched edge damage occurred.

Test No. 25 is an example in which the value of [Ti]×[C] was larger than 0.0160. This is an example in which coarse TiC precipitates were precipitated at a high temperature, and the mean number density of TiC precipitates and the tensile strength decreased.

Test No. 32 is an example in which the content of Ti was small and the ratio of [Ti]/[C] was smaller than 0.16. This is an example in which the mean number density of TiC precipitates, the matrix-precipitated Ti ratio, and the tensile strength decreased.

Test No. 33 is an example in which the cooling rate in the range from [MT+50] ° C. to [MT] ° C. during the primary cooling was lower than the average cooling rate in the range from the start of the primary cooling to the primary cooling stop temperature MT [° C.]+50° C. This is an example in which the area ratio of polygonal ferrite was increased, and, additionally, precipitation of TiC precipitates on dislocations was promoted, and the mean number density of TiC precipitates, the matrix-precipitated Ti ratio, and the tensile strength decreased.

Test No. 34 is an example in which the cooling rate in the range from [MT+50] ° C. to [MT] ° C. during the primary cooling was lower than the average cooling rate in the range from the start of the primary cooling to the primary cooling stop temperature MT [° C.]+50° C. This is an example in which the area ratio of polygonal ferrite was increased, and, additionally, precipitation of TiC precipitates on dislocations was promoted, and the mean number density of TiC precipitates, the matrix-precipitated Ti ratio, and the tensile strength decreased.

The preferred embodiments and examples of the present disclosure have been described above, but the present disclosure is not limited to such examples. It is obvious that those skilled in the art can conceive various variations or modifications within the scope of the idea set forth in the claims, and it is understood that those variations or modifications naturally belong to the technical scope of the present disclosure.

The disclosure of Japanese Patent Application No. 2020-074180 filed on Apr. 17, 2020 is incorporated herein by reference in its entirety.

All documents, patent applications, and technical standards described herein are incorporated herein by reference to the same extent as if each document, patent application, and technical standard are specifically and individually indicated to be incorporated by reference.

The invention claimed is:

1. A high-strength hot-rolled steel sheet having a chemical composition comprising, by mass:

C: from 0.030 to 0.250%;
Si: from 0.01 to 1.50%;
Mn: from 0.1 to 3.0%;
Ti: from 0.040 to 0.200%;
P: 0.100% or less;
S: 0.005% or less;
Al: 0.500% or less;
N: 0.0090% or less;
B: from 0 to 0.0030%;
a total of one or more of Nb, Mo and V: from 0 to 0.040%;
a total of one or more of Ca and REM: from 0 to 0.010%; and
a balance of Fe and impurities, a mass ratio [Ti]/[C] of a Ti amount to a C amount being from 0.16 to 3.00, and a product [Ti]×[C] of the Ti amount and the C amount being from 0.0015 to 0.0160, the high-strength hot-rolled steel sheet:

having a mean dislocation density of from $1\times10^{14}$ to $1\times10^{16}$ $m^{-2}$; and
comprising at least bainitic ferrite,
wherein a total area ratio of the bainitic ferrite and ferrite is 70% or more and less than 85% [90%],
wherein a total area ratio of martensite and retained austenite is 5% or more and 30% or less,
wherein, in ferrite crystal grains and in bainitic ferrite crystal grains, a mean number density of TiC precipitates is from $1\times10^{17}$ to $5\times10^{18}$ precipitates $cm^3$,
wherein an amount of Ti present as a TiC precipitate precipitated in a matrix not on dislocations is 30 mass % or more of a total amount of Ti in the steel sheet,
wherein a tensile strength is 850 MPa or more, and
wherein [Ti] and [C] represent the Ti amount and the C amount in mass %, respectively.

2. The high-strength hot-rolled steel sheet according to claim 1, comprising, by mass:

B: 0.0001% or more and less than 0.0005%.

3. The high-strength hot-rolled steel sheet according to claim 1, comprising, by mass:

the total of one or more of Nb, Mo, and V: from 0.01 to 0.040%.

4. The high-strength hot-rolled steel sheet according to claim 1, comprising, by mass:

the total of one or more of Ca and REM: from 0.0005 to 0.01%.

5. The high-strength hot-rolled steel sheet according to claim 1, wherein the total area ratio of the bainitic ferrite and the ferrite is 80% or more and less than 85%.

6. The high-strength hot-rolled steel sheet according to claim 1, wherein an area ratio of the bainitic ferrite is 50% or more and less than 85%.

* * * * *